US009104165B2

(12) United States Patent
Eguchi

(10) Patent No.: US 9,104,165 B2
(45) Date of Patent: Aug. 11, 2015

(54) IMAGE FORMING APPARATUS AND METHOD OF HANDLING A SHEET CONVEYANCE ERROR THEREIN

(71) Applicant: Yosuke Eguchi, Tokyo (JP)

(72) Inventor: Yosuke Eguchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/199,076

(22) Filed: Mar. 6, 2014

(65) Prior Publication Data

US 2014/0294406 A1 Oct. 2, 2014

(30) Foreign Application Priority Data

Mar. 27, 2013 (JP) ..... 2013-066032

(51) Int. Cl.
*G03G 15/00* (2006.01)

(52) U.S. Cl.
CPC ..... *G03G 15/706* (2013.01); *G03G 15/6573* (2013.01); *G03G 15/70* (2013.01)

(58) Field of Classification Search
USPC ..... 399/21
See application file for complete search history.

(56) References Cited

U.S. PATENT DOCUMENTS

| | | | | |
|---|---|---|---|---|
| 6,958,677 | B1 * | 10/2005 | Carter | 340/10.1 |
| 2004/0109704 | A1 * | 6/2004 | Abe | 399/107 |
| 2004/0136736 | A1 * | 7/2004 | Inaba | 399/38 |
| 2007/0286656 | A1 * | 12/2007 | Ito | 399/389 |
| 2008/0166165 | A1 * | 7/2008 | Mohri | 399/397 |
| 2009/0022503 | A1 * | 1/2009 | Mae et al. | 399/12 |
| 2009/0285594 | A1 * | 11/2009 | Kichise et al. | 399/75 |
| 2010/0074636 | A1 * | 3/2010 | Okano | 399/21 |
| 2010/0119244 | A1 * | 5/2010 | Kitagawa | 399/21 |
| 2011/0097093 | A1 * | 4/2011 | Birumachi | 399/21 |

FOREIGN PATENT DOCUMENTS

| | | |
|---|---|---|
| JP | 2001-005345 | 1/2001 |
| JP | 2005-225672 | 8/2005 |
| JP | 2006-098470 | 4/2006 |
| JP | 2009-256099 | 11/2009 |
| JP | 2011-242501 | 12/2011 |

* cited by examiner

*Primary Examiner* — Anthony Nguyen
(74) *Attorney, Agent, or Firm* — Harness, Dickey & Pierce, P.L.C.

(57) ABSTRACT

An image forming apparatus, in which a method of handling a sheet conveyance error is performed, includes an apparatus body, a fixing unit fixing an image to a recording medium at a nip area thereof, a sheet conveying path, a sheet output roller unit outputting the recording medium outside the apparatus body, a sheet output detector detecting the recording medium, a post-fixing nip detector detecting the recording medium, a notifying unit notifying a user of an error recovery process when the error is detected by the error detector, and a controller. A distance from the post-fixing nip detector to the sheet output detector is smaller than a given size of the recording medium. When the error is detected by the error detector and the recording medium is detected by the sheet output detector, the controller causes the notifying unit to display a different process according to the detection results.

8 Claims, 6 Drawing Sheets

IMAGE FORMING APPARATUS AND METHOD OF HANDLING A SHEET CONVEYANCE ERROR THEREIN

CROSS-REFERENCE TO RELATED APPLICATIONS

This patent application is based on and claims priority pursuant to 35 U.S.C. §119 to Japanese Patent Application No. 2013-066032, filed on Mar. 27, 2013 in the Japan Patent Office, the entire disclosure of which is hereby incorporated by reference herein.

BACKGROUND

1. Technical Field

Embodiments of the present invention relate to an image forming apparatus that includes a fixing unit to fix an image to a sheet at a nip area formed between rotary bodies that rotate by contacting each other.

2. Related Art

In known image forming apparatuses, a sheet detection sensor detects a status of sheet conveyance. Based on the detection results obtained by the sheet detection sensor, for example, a subsequent sheet has not arrived within a given time period and/or the sheet has been detected over a given time period, it is determined that a paper jam has occurred.

As an example image forming apparatus having the above-described technique, Japanese Patent Application Publication No. JP 2001-005345-A discloses a configuration in which, when passage of a sheet is detected by a first sensor disposed upstream from a fixing unit in a sheet conveying direction and is not detected by a second sensor disposed downstream from the fixing unit in the sheet conveying direction within a given time period after the sheet has passed the first sensor, it is determined that a paper jam has occurred, and the image forming apparatus displays a process of removing a jammed sheet from the fixing unit.

As another example, Japanese Patent Application Publication No. JP 2009-256099-A discloses a configuration in which a part of a sheet is exposed from a sheet discharging port before reversing a sheet conveying direction. This configuration determines a sheet removing direction according to an amount of the sheet exposed from the sheet discharging port and displays an error when a paper jam occurs.

As yet another example, Japanese Patent Application Publication No. JP 2011-242501-A discloses a configuration in which a conveying roller pair that is rotated by a gear train provided with a one-way clutch conveys a sheet. At occurrence of paper jam in a fixing unit, the configuration determines whether a jammed sheet is wound around a rotary body of the fixing unit or a jammed sheet has a bellows or accordion shape immediately after passing a nip area formed between rotary bodies of the fixing unit. Then, the configuration displays the status on a display unit of the image forming apparatus and switches a direction of discharging the jammed sheet between an upstream direction and a downstream direction.

However, when the sheet is jammed at a position downstream from the fixing unit in the vicinity of a unit that discharges the sheet to an outside of the image forming apparatus, conventional image forming apparatuses notify a user of occurrence of a sheet conveyance error such as a paper jam with a process to eliminate the paper jam to open/close a cover and to pull out the jammed sheet toward the cover. Specifically, when the jammed sheet exists downstream from the fixing unit, the jammed sheet may be held by the fixing unit having a large sheet holding force. Therefore, the process of removing the jammed sheet is sent to pull out the jammed sheet from the fixing unit safely.

Accordingly, if the sheet is not held by the fixing unit even when the jammed sheet resides at a position downstream from the fixing unit, the jammed sheet can be pulled out from the outside of the image forming apparatus without opening/closing the cover. Regardless of this, the jammed sheet was removed by opening/closing the cover to remove the jammed sheet, which was an extra labor or operation.

The configuration disclosed in JP 2001-005345-A is to prevent the sheets from sequentially jamming in the fixing unit, and is not to determine whether the jammed sheet is held by the rotary bodies of the fixing unit.

Similar to JP 2001-005345-A, the configuration disclosed in JP 2009-256099-A is not to determine whether the jammed sheet is held by the rotary bodies of the fixing unit. When the fixing unit has the jammed sheet therein, it is likely that removal of the jammed sheet from a sheet discharging unit is significantly delayed.

The configuration disclosed in JP 2011-242501-A is not to determine whether the jammed sheet stopped in the fixing unit has reached a unit disposed downstream from the fixing unit to discharge the jammed sheet to the outside of the image forming apparatus.

Accordingly, the conventional image forming apparatuses have not notified of the user of any process to instruct whether the jammed sheet is removed by pulling out from an outside of the image forming apparatus or from an openable/closable part of the image forming apparatus.

SUMMARY

At least one embodiment of the present invention provides an image forming apparatus including an apparatus body, a fixing unit, a sheet conveying path, a sheet output roller unit, a sheet output detector, a post-fixing nip detector, a notifying unit, and a controller. The fixing unit is disposed in the apparatus body and has rotary bodies disposed facing each other with a nip area formed therebetween. The fixing unit fixes an image to a recording medium at the nip area while the rotating rotary bodies are rotating. Through the sheet conveying path, the recording medium is conveyed in a sheet conveying direction. The sheet output roller unit is disposed downstream from the fixing unit in the sheet conveying direction. The sheet output roller unit outputs the recording medium to an outside of the apparatus body. The sheet output detector is disposed in a vicinity of the sheet output roller unit in the sheet conveying path. The sheet output detector detects presence of the recording medium in a range of detection thereof. The post-fixing nip detector is disposed downstream from the nip area of the fixing unit in the sheet conveying path. The post-fixing nip detector detects presence of the recording medium in a range of detection thereof. The notifying unit notifies a user of a process of removing the error when the error is detected by the error detector.

Further, at least one embodiment of the present invention provides a method of handling a sheet conveyance error in an image forming apparatus, the method including providing a sheet output detector, a post-fixing nip detector, and an error detector to detect presence of a recording medium, providing an openable/closable part to reverse and convey the recording medium for a duplex printing operation, detecting a sheet conveyance error that a recording medium is jammed in a vicinity of a fixing unit of the image forming apparatus, determining whether or not the recording medium is held by rotary bodies of the fixing unit, and notifying a user of detection of the sheet conveyance error by displaying one of a first error recovery process of removing the recording medium via the sheet output roller unit when the recording medium is detected by the sheet output detector and the recording medium is not held by the rotary bodies of the fixing unit, and a second error recover process of removing the recording medium via the openable/closable part when the recording medium is detected by the sheet output detector and the post-fixing nip detector and the recording medium is held by the rotary bodies of the fixing unit.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
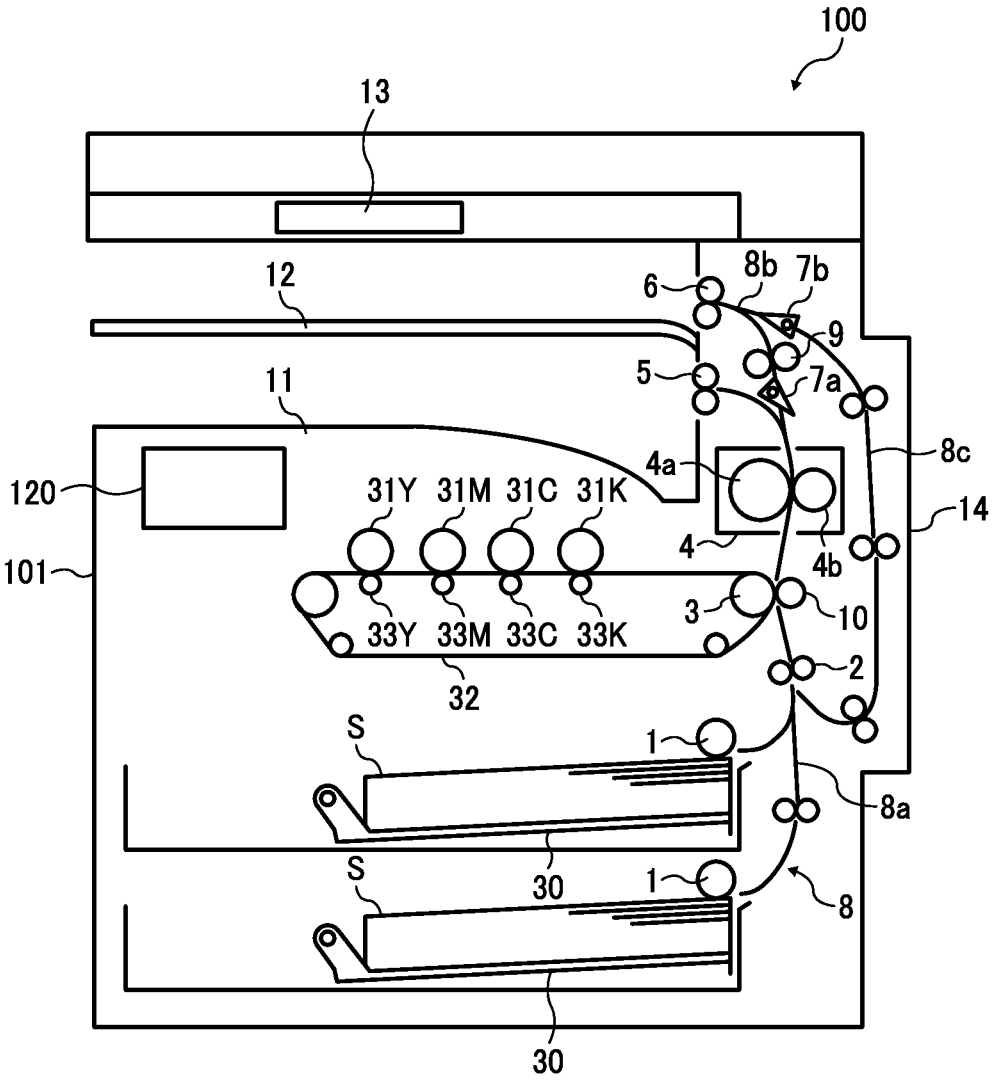
FIG. 1 is a diagram illustrating an example configuration of an image forming apparatus according to an embodiment of the present invention.
Figure 2:
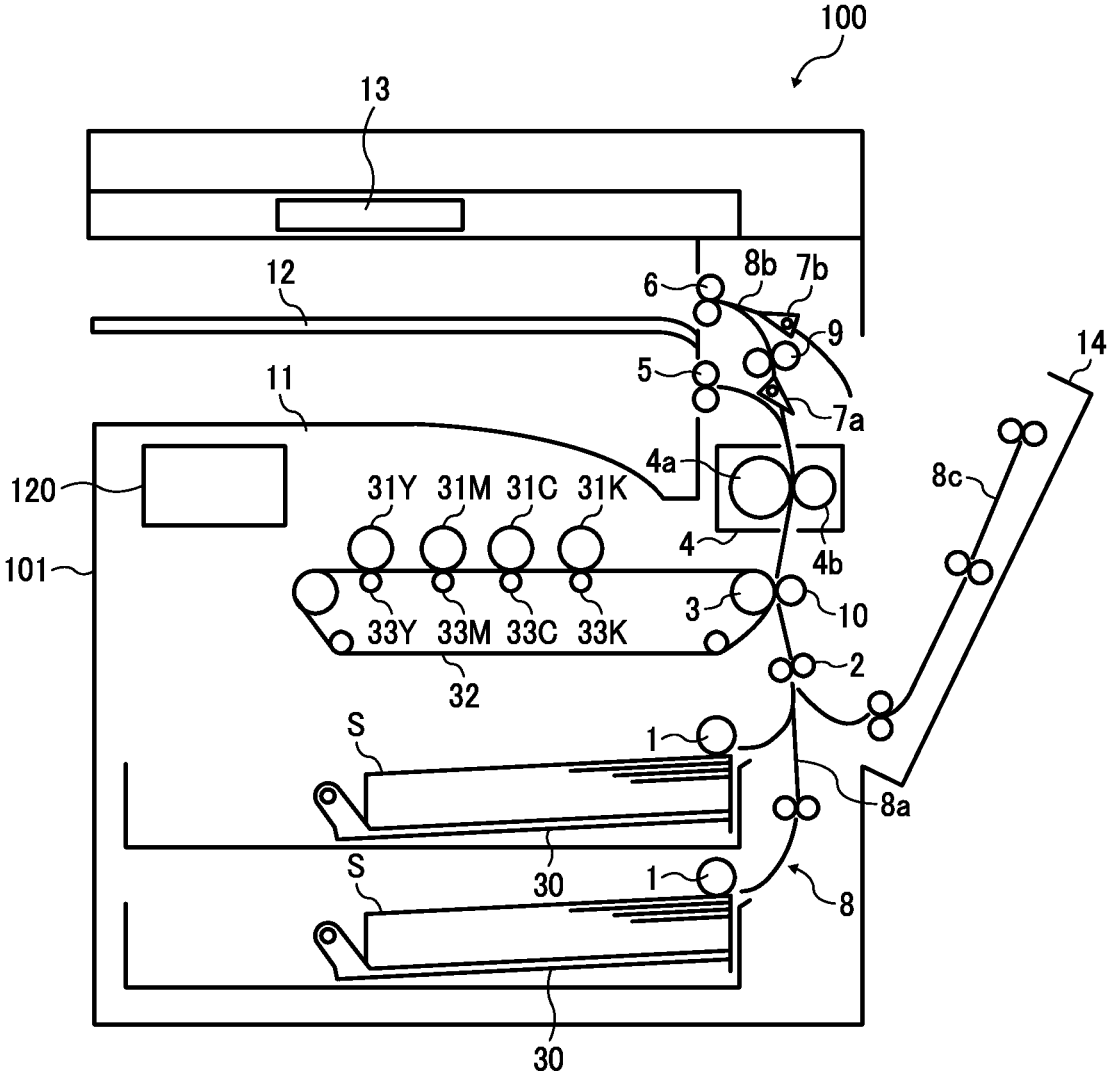
FIG. 2 is a diagram illustrating the image forming apparatus with a duplex printing unit attached to the image forming apparatus open.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an image forming apparatus 100 according to an embodiment of the present invention with reference to the drawings.

The image forming apparatus 100 may be a copier, a facsimile machine, a printer, a plotter, a multifunction peripheral or a multifunction printer (MFP) having at least one of copying, printing, scanning, facsimile, and plotter functions, or the like. According to the present embodiment, the image forming apparatus 100 is an electrophotographic color printer that forms color and monochrome toner images on a sheet or sheets by electrophotography.

Further, it is to be noted in the following embodiments that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

A description is given of a configuration of the image forming apparatus 100 according to an embodiment, with reference to FIG. 1.

As illustrated in FIG. 1, the image forming apparatus 100 according to an embodiment includes an apparatus body 101 that includes image forming units and components. The apparatus body 101 accommodates a sheet tray 30 that contains a stack of sheets including a sheet S, a feed roller 1 that feeds the sheet S from the sheet tray 30, a registration roller pair 2, a belt drive roller 3, a fixing unit 4, a sheet discharging roller pair 5 that functions as a sheet output roller unit, a sheet conveying path 8, and a sheet discharging tray 11.

It is to be noted that the sheet S travels in the image forming apparatus 100 along the sheet conveying path 8. The sheet conveying path 8 includes a regular conveying path 8*a*, a reverse sheet conveying path 8*b*, and a duplex conveying path 8*c*. The regular conveying path 8*a* extends from an exit of the sheet tray 30, which is at or about the feed roller 1, to the sheet discharging roller pair 5. The reverse sheet conveying path 8*b* extends from a branching point of the regular conveying path 8*a* in the vicinity of separators 7*a* and 7*b* to a reverse roller pair 6, both of which are described below. The duplex conveying path 8*c* extends from the reverse roller pair 6 to a portion immediately before the registration roller pair 2 defining a part of the regular conveying path 8*a*.

The image forming apparatus 100 further includes photoconductor drums 31Y, 31M, 31C, and 31K, an intermediate transfer belt 32, primary transfer rollers 33Y, 33M, 33C, and 33K, and a secondary transfer roller 10. Each of the photoconductor drums 31Y, 31M, 31C, and 31K functions as an image carrier to form and carry a toner image on a surface thereof. The intermediate transfer belt 32 is an endless loop wound around multiple rollers including the belt drive roller 3. The intermediate transfer belt 32 receives respective single color toner images transferred from the photoconductor drums 31Y, 31M, 31C, and 31K. The respective single color toner images are sequentially transferred onto an outer surface of the intermediate transfer belt 32 in an overlaid manner so as to form a composite color toner image. The primary transfer rollers 33Y, 33M, 33C, and 33K are in contact with an inner surface of the intermediate transfer belt 32 and are disposed facing the photoconductor drums 31Y, 31M, 31C, and 31K, respectively, with the intermediate transfer belt 32 interposed therebetween. The respective single color toner images formed on the photoconductor drums 31Y, 31M, 31C, and 31K are transferred onto the intermediate transfer belt 32 with the aid of the primary transfer rollers 33Y, 33M, 33C, and 33K. The secondary transfer roller 10 is in contact with the outer surface of the intermediate transfer belt 32 and is disposed facing the belt drive roller 3 with the intermediate transfer belt 32 interposed therebetween. The composite color toner image formed on the intermediate transfer belt 32 is transferred onto the sheet S conveyed by the registration roller pair 2 in the regular conveying path 8*a* with the aid of the secondary transfer roller 10.

A description is given of image forming operations performed in the image forming apparatus 100.

It is to be noted that the technique of image formation by which a toner image is formed and transferred onto a sheet is known. Therefore, an overall description of image formation technique used in the present embodiment is described with reference to FIG. 1.

The sheet S is fed one by one from the sheet tray 30 by the feed roller 1 into the regular sheet conveying path 8*a* and corrected skew at the registration roller pair 2. Respective single color toner images formed on the photoconductors 31Y, 31M, 31C, and 31K are transferred onto the intermediate transfer belt 32 by the respective primary transfer rollers 33Y, 33M, 33C, and 33K to form a composite color toner image. Then, the color toner image on the intermediate transfer belt 32 is transferred onto the sheet S by the belt drive roller 3 and the secondary transfer roller 10. The sheet S having the toner image thereon is conveyed to the fixing unit 4. After the toner image is fixed to the sheet S, the sheet S is discharged by the sheet discharging roller pair 5 toward the outside of the image forming apparatus 100. The sheet S discharged by the sheet discharging roller pair 5 as a sheet output roller unit is stacked on the sheet discharging tray 11 subsequently.

As illustrated in FIG. 1, the image forming apparatus 100 according to the present embodiment further includes the reverse roller pair 6 that functions as a sheet output roller unit, the separators 7*a* and 7*b*, a reverse relay roller pair 9, a reverse sheet tray 12, and a duplex unit 14. With this configuration, the image forming apparatus 1*d*00 according to the present embodiment can perform duplex printing.

After the toner image is fixed to a front side of the sheet S in the fixing unit 4 during a duplex printing operation, the separators 7*a* and 7*b* switch the direction of sheet conveyance toward the reverse sheet conveyance path 8*b*. By so doing, the sheet S is conveyed into the reverse sheet conveying path 8*b* toward the reverse roller pair 6 via the reverse relay roller pair 9. The reverse roller pair 6 that functions as a sheet output roller unit rotates to output a part of the sheet S to the reverse sheet tray 12, and then reverses its rotation to convey the sheet S to the duplex conveying path 8*c* in the duplex unit 14. Then, the sheet S is conveyed to the registration roller pair 2 to perform the duplex printing operation onto a back side of the sheet S.

The image forming apparatus 100 illustrated in FIG. 1 further includes an operation unit 13 and a controller 120. The operation unit 13 includes a touch panel and a display unit. A user operates the image forming apparatus 100 via the operation unit 13.

The controller 120 includes a central processing unit (CPU) and a memory to perform a control of information that is shown via or displayed on the operation unit 13 and a control of the entire operations of the image forming apparatus 100.

The duplex unit 14 opens/closes with respect to the apparatus body 101 of the image forming apparatus 100 and has at least a part of the duplex conveying path 8*c*. Therefore, when a paper jam occurs due to slippage of a sheet conveying roller in the sheet conveying path 8, the duplex unit 14 defining the duplex conveying path 8*c* is opened to remove a jammed sheet or jammed sheets remaining therein.

Figure 3:
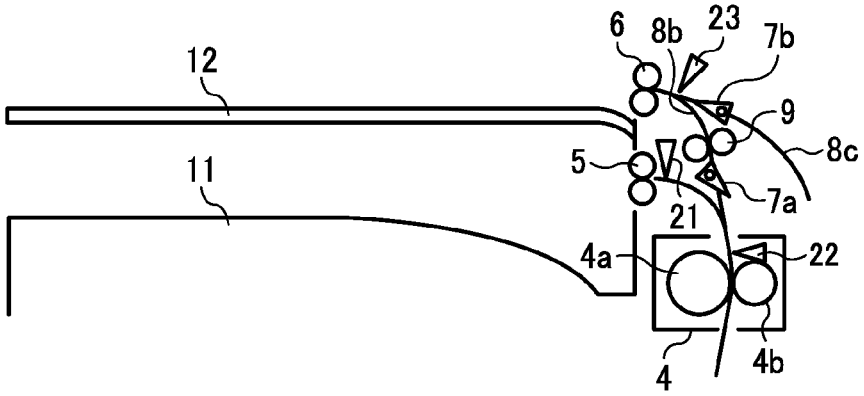
FIG. 3 is a diagram illustrating a sheet conveying path extending downstream of a fixing unit of the image forming apparatus.

FIG. 3 is a diagram illustrating a downstream part of the image forming apparatus 100 according to an embodiment. The downstream part ranges over a part that is downstream from the fixing unit 4 in the image forming apparatus 100.

As illustrated in FIG. 3, the image forming apparatus 100 according to an embodiment includes an output sheet detection sensor 21 that is disposed upstream from the sheet discharging roller pair 5 in the regular sheet conveying path 8*a* through which the sheet S is conveyed in the apparatus body 101 of the image forming apparatus 100. The output sheet detection sensor 21 is located close to the sheet discharging roller pair 5 within a range where the output sheet detection sensor 21 does not interfere with the sheet discharging roller pair 5 when the output sheet detection sensor 21 detects completion of sheet output to the outside of the image forming apparatus 100.

The fixing unit 4 includes, for example, a fixing roller 4*a*, and a pressure roller 4*b*, both of which contact each other and function as a rotary body. The fixing roller 4*a* and the pressure roller 4*b* are disposed in contact with each other to form a nip area where the sheet S is held. By holding the sheet S at the nip area, the fixing roller 4*a* applies heat by a heater provided therein and the pressure roller 4*b* applies pressure, so as to fix a toner image to the sheet S.

A post-fixing nip detection sensor 22 is disposed downstream from the nip area of the fixing unit 4 in the sheet conveying units to detect the sheet S. The post-fixing nip detection sensor 22 is located close to the nip area of the fixing unit 4 within a range where the post-fixing nip detection sensor 22 does not interfere with the fixing unit 4 when the post-fixing nip detection sensor 22 detects completion of passage of the sheet S from the nip area of the fixing unit 4.

Further, a reverse sheet detection sensor 23 detects presence of the sheet S. The reverse sheet detection sensor 23 is disposed in the vicinity of the separator 7*a* at which the sheet conveying path 8 is branched to the reverse sheet conveying unit 8*b* toward the reverse roller pair 6 and the separator 7*b* at which the sheet conveying path 8 is branched to the duplex conveying path 8*c* of the duplex unit 14. The reverse sheet detection sensor 23 is located close to the reverse roller pair 6 within a range where the reverse sheet detection sensor 23 does not interfere with the reverse roller pair 6 when the reverse sheet detection sensor 23 detects conveyance of the sheet S to the reverse roller pair 6.

A distance between the post-fixing nip detection sensor 22 and the output sheet detection sensor 21 in the regular conveying path 8*a* is arranged to be shorter or smaller than a length of a sheet having a given size of a sheet such as A4, B5, and postcard for image formation in the regular sheet conveying path 8*a*.

Based on the above-described setting, when the sheet S is detected by both the post-fixing nip detection sensor 22 and the output sheet detection sensor 21, for example, it is determined that one sheet, i.e., the sheet S, stays within a range of from the nip area of the fixing unit 4 to the sheet discharging roller pair 5 in the regular sheet conveying path 8*a*.

A distance between the post-fixing nip detection sensor 22 and the reverse sheet detection sensor 23 in the regular sheet conveying path 8*a* is also arranged to be shorter or smaller than the length of the sheet having the above-described given size used for image formation in the regular sheet conveying path 8*a*.

Based on the above-described setting, when the sheet S is detected by both the post-fixing nip detection sensor 22 and the reverse sheet detection sensor 23, for example, it is determined that one sheet, i.e., the sheet S, stays within a range of from the nip area of the fixing unit 4 to the reverse roller pair 6 in the regular sheet conveying path 8*a*.

When being discharged from the fixing unit 4 to the outside of the apparatus body 101 of the image forming apparatus 100, the sheet S passes by the output sheet detection sensor 21 before being discharged by the sheet discharging roller pair 5 to the sheet discharging tray 11. In a case in which the sheet S has passed by the post-fixing nip detection sensor 22 and a trailing edge of the sheet S does not pass by the output sheet detection sensor 21 within a given time period, the controller 120 of the image forming apparatus 100 determines that a paper jam has occurred and stops further conveyance of the sheet S. Specifically, at occurrence of sheet conveyance error (e.g., paper jam), the controller 120 functions as an error detector to control a sheet conveying operation and stop conveyance of the sheet S. The sheet conveying operation is illustrated in FIGS. 4A and 4B and a flowchart of procedure of the sheet conveying operation performed by the controller 120 is depicted in FIG. 5.

Figure 4A:
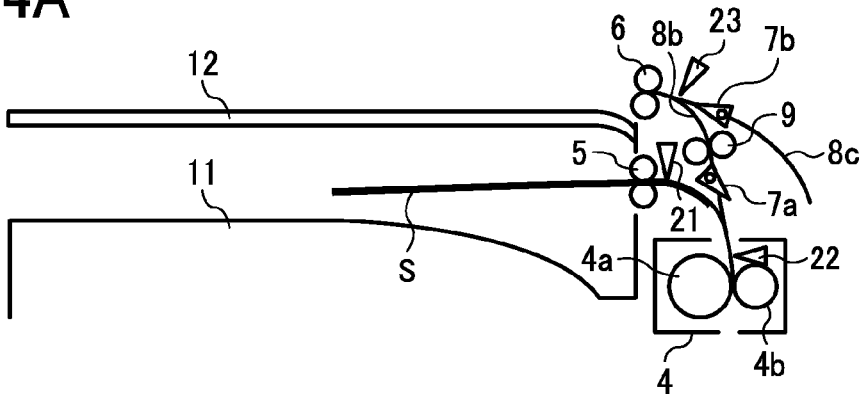
FIG. 4A is a diagram illustrating an example of occurrence of sheet conveyance error detected by an output sheet detection sensor.
Figure 4B:
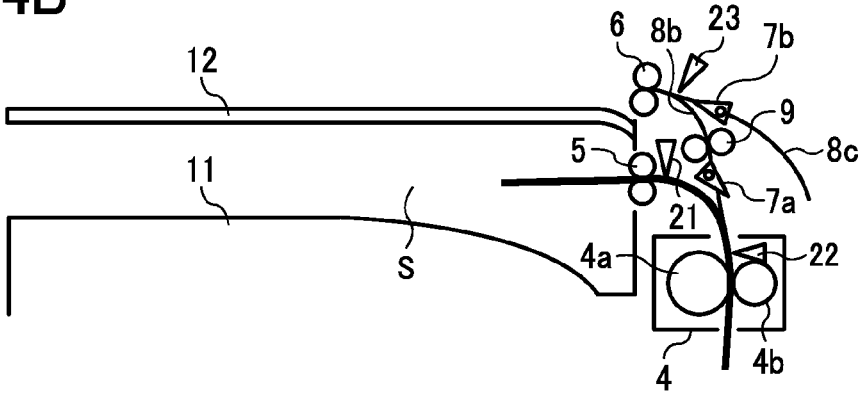
FIG. 4B is a diagram illustrating another example of occurrence of sheet conveyance error detected by the output sheet detection sensor.
Figure 5:
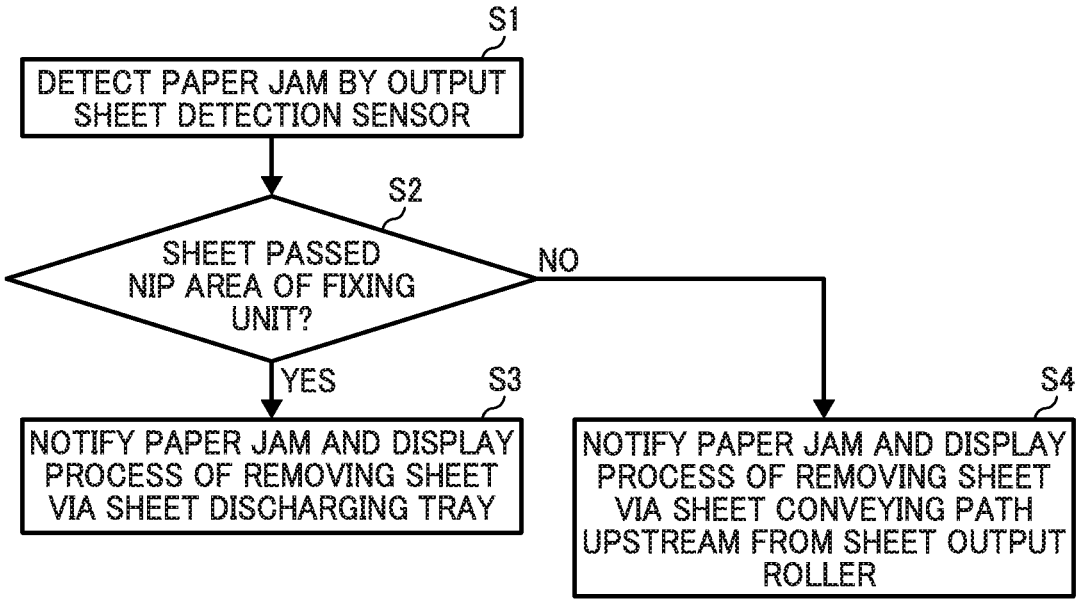
FIG. 5 is a diagram illustrating a flowchart of a series of procedure for handling the sheet conveyance error by a controller.

Before describing details of the sheet conveying operation with reference to FIGS. 4A and 4B, a description is given of procedure for handling a paper jam in the sheet conveying operation with reference to the flowchart of FIG. 5.

In step S1, the output sheet detection sensor 21 detects occurrence of a paper jam.

After detection of the paper jam in step S1, the controller 120 checks whether or not the post-fixing nip detection sensor 22 detects that the sheet S has passed the nip area of the fixing unit 4 in step S2.

When the post-fixing nip detection sensor 22 detects that the sheet S has passed the nip area of the fixing unit 4 in step S2, the controller 120 notifies users of occurrence of the paper jam and causes the operation unit 13 to display a process of removing the jammed sheet S to the outside of the apparatus body 101 via the sheet discharging tray 11 in step S3.

When the post-fixing nip detection sensor 22 does not detect the sheet S in step S2, the controller 120 notifies the users of occurrence of the paper jam and causes the operation unit 13 to display a process of removing the jammed sheet S to the outside of the apparatus body 101 via an openable/closable sheet conveying path that extends upstream from the sheet discharging roller pair 5 in the sheet conveying direction in step S4. In this case, the openable/closable sheet conveying path corresponds to the duplex conveying path 8*c* of the duplex unit 14.

In a state as illustrated in FIG. 4A, the output sheet detection sensor 21 detects that the sheet S on its way to the sheet discharging tray 11 is held by the sheet discharging roller pair 5. At the same time, FIG. 4A depicts that the post-fixing nip detection sensor 22 does not detect the sheet S in this state. Accordingly, the trailing edge of the sheet S has passed the nip area of the fixing unit 4 in this state.

When the sheet S is in the state illustrated in FIG. 4A, the jammed sheet S can be pulled out from the sheet discharging tray 11 to the outside of the apparatus body 101 with a relatively small force of approximately 4 N without opening/closing the duplex unit 14.

Accordingly, as illustrated in FIG. 4A, when the sheet S is detected by the output sheet detection sensor 21 but not detected by the post-fixing nip detection sensor 22, the controller 120 displays the process of removing the jammed sheet S via the sheet discharging tray 11 on the operation unit 13 as instructions. In the flowchart illustrated in FIG. 5, according to the detection result that the trailing edge of the sheet S has passed the post-fixing nip detection sensor 22, the controller 120 causes the operation unit 13 to display the process of removing the jammed sheet S to the outside of the apparatus body 101 via the sheet discharging tray 11 in step S3.

Thus, the controller 120 notifies the users of occurrence of paper jam and causes the operation unit 13 to display the process of removing the jammed sheet S via the sheet discharging tray 11. By so doing, the controller 120 functions as a notifying unit to show the error recovery process for handling the sheet conveyance error due to the paper jam.

For displaying the error recovery process, the controller 120 reads a reference table that is stored in a memory to specify a suitable error recovery process for handling removal of the jammed sheet S in sheet error detection. By so doing, the controller 120 determines the process of removing the jammed sheet according to detection results obtained by each sensor. Accordingly, the controller 120 causes the operation unit 13 to display the specified error recovery process together with occurrence of a paper jam.

In a state illustrated in FIG. 4B, the output sheet detection sensor 21 detects that the sheet S on its way to the sheet discharging tray 11 is held by the sheet discharging roller pair 5. At the same time, FIG. 4B depicts that the post-fixing nip detection sensor 22 detects the sheet S in this state. Accordingly, the trailing edge of the sheet S has not passed the nip area of the fixing unit 4 in this state.

When the sheet S is in the state illustrated in FIG. 4B, a relatively large force of approximately 20 N is required to pull out and remove the jammed sheet S from the nip area of the fixing unit 4. Further, the regular sheet conveying path 8*a* extending from the nip area of the fixing unit 4 to the sheet discharging roller pair 5 is significantly curved. Therefore, when the jammed sheet S is pulled out from the sheet discharging tray 11 with the relatively large force, the force is exerted to inner parts of rollers disposed inside the curved portion of the regular sheet conveying path 8*a*. Consequently, it is likely to damage the inner parts of the rollers disposed inside the curved portion.

Accordingly, as shown in FIG. 4B, when the sheet S is detected by both the output sheet detection sensor 21 and the post-fixing nip detection sensor 22, the controller 120 displays the error recovery process of removing the jammed sheet S via the duplex unit 14 on the operation unit 13 as instructions. In this case, the process displayed on the operation unit 13 instructs the users to open the duplex unit 14 before pulling out the jammed sheet from the duplex conveying path 8*c* of the opened duplex unit 14. In the flowchart illustrated in FIG. 5, according to the detection result that the trailing edge of the sheet S has not passed the post-fixing nip detection sensor 22, the controller 120 causes the operation unit 13 to display the error recovery process of removing the jammed sheet S to the outside of the apparatus body 101 via the duplex conveying path 8*c* of the openable/closable duplex unit 14 in step S4.

Thus, the controller 120 notifies the users of occurrence of the paper jam and causes the operation unit 13 to display the error recovery process of removing the jammed sheet S via the duplex unit 14. By so doing, the controller 120 functions as a notifying unit to inform the error recovery process for handling the sheet conveyance error due to the paper jam.

For displaying the error recovery process, the controller 120 reads the reference table that is stored in the memory to specify a suitable error recovery process for handling removal of the jammed sheet S in sheet error detection. By so doing, the controller 120 determines the error recovery process according to detection results obtained by each sensor. Accordingly, the controller 120 causes the operation unit 13 to display the specified error recovery process together with occurrence of paper jam.

Similarly, the above-described control of the sheet conveying operation in sheet error detection can be applied when the sheet S output from the fixing unit 4 is conveyed to the reverse roller pair 6.

Specifically, the sheet S that has been output from the fixing unit 4 passes by the reverse sheet detection sensor 23 before being output by the reverse roller pair 6 toward the reverse sheet tray 12. In a case in which the trailing edge of the sheet S does not pass by the reverse sheet detection sensor 23 within a given time period after the sheet S has passed by the post-fixing nip detection sensor 22, the controller 120 of the image forming apparatus 100 determines that a paper jam has occurred and stops further conveyance of the sheet S. Specifically, at occurrence of sheet conveyance error by paper jam, the controller 120 functions as an error detector to control the sheet conveying operation and stop further conveyance of the sheet S. The sheet conveying operation is illustrated in FIGS. 6A and 6B and the flowchart of procedure of the sheet conveying operation performed by the controller 120 is depicted in FIG. 5.

Figure 6A:
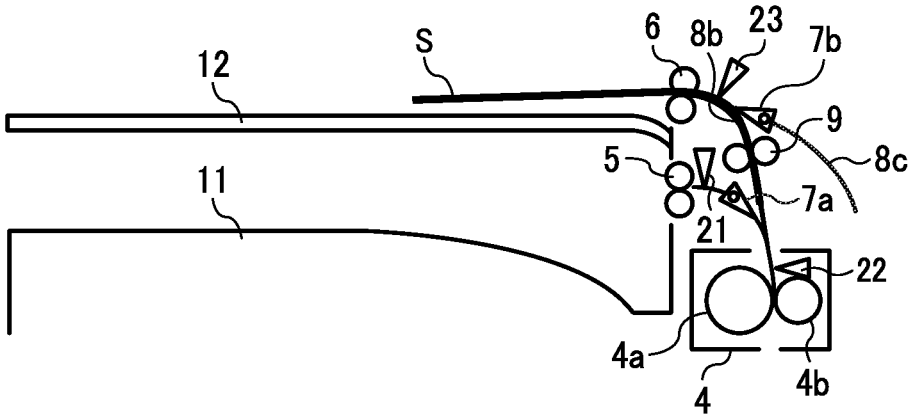
FIG. 6A is a diagram illustrating an example of occurrence of sheet conveyance error detected by a reverse sheet detection sensor.
Figure 6B:
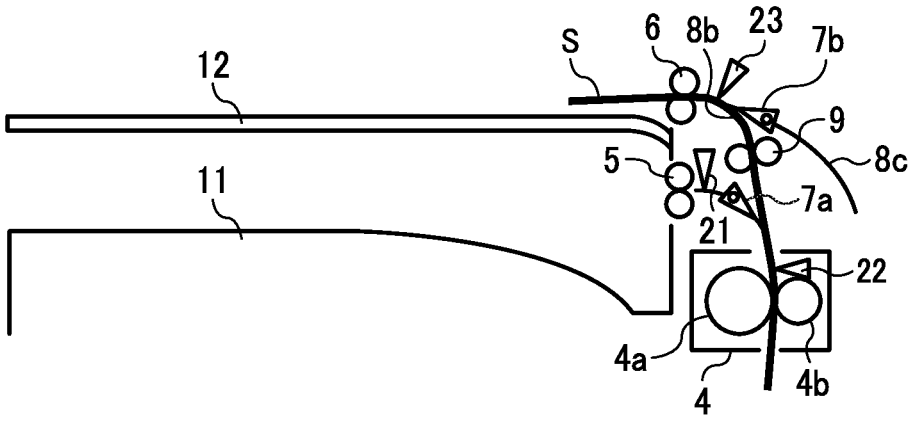
FIG. 6B is a diagram illustrating another example of occurrence of sheet conveyance error detected by the reverse sheet detection sensor.

In a state illustrated in FIG. 6A, the reverse sheet detection sensor 23 detects that the sheet S on its way to the reverse sheet tray 12 is held by the reverse roller pair 6 and the reverse relay roller pair 9. At the same time, FIG. 6A depicts that the post-fixing nip detection sensor 22 does not detect the sheet S in this state. Accordingly, the trailing edge of the sheet S has passed the nip area of the fixing unit 4 in this state.

When the sheet S is in the state illustrated in FIG. 6A, the jammed sheet S can be pulled out from the reverse sheet tray 12 to the outside of the apparatus body 101 with a relatively small force of approximately 10 N without opening/closing the duplex unit 14.

Accordingly, as illustrated in FIG. 6A, when the sheet S is detected by the reverse sheet detection sensor 23 but not detected by the post-fixing nip detection sensor 22, the controller 120 displays the process of removing the jammed sheet S via the reverse sheet tray 12 on the operation unit 13 as instructions. Similarly, in the flowchart illustrated in FIG. 5, according to the detection result that the trailing edge of the sheet S has passed the post-fixing nip detection sensor 22, the controller 120 causes the operation unit 13 to display the process of removing the jammed sheet S to the outside of the apparatus body 101 via the reverse sheet tray 12 in step S3.

Thus, the controller 120 notifies the users of occurrence of paper jam and causes the operation unit 13 to display the process of removing the jammed sheet via the reverse sheet tray 12. By so doing, the controller 120 functions as a notifying unit to show the error recovery process for handling the sheet conveyance error due to the paper jam.

For displaying the error recovery process, the controller 120 reads the reference table in the memory to specify a suitable error recovery process for handling removal of the jammed sheet S in sheet error detection. By so doing, the controller 120 determines the error recovery process according to detection results obtained by each sensor. Accordingly, the controller 120 causes the operation unit 13 to display the specified error recovery process together with occurrence of a paper jam.

In a state illustrated in FIG. 6B, the reverse sheet detection sensor 23 detects that the sheet S on its way to the reverse sheet tray 12 to be reversed is held by the reverse roller pair 6 and the reverse relay roller pair 9. At the same time, FIG. 6B depicts that the post-fixing nip detection sensor 22 detects the sheet S in this state. Accordingly, the trailing edge of the sheet S has not passed the nip area of the fixing unit 4 in this state.

When the sheet S is in the state illustrated in FIG. 6B, a relatively large force of approximately 20 N is required to pull out and remove the jammed sheet S from the nip area of the fixing unit 4. Further, the reverse sheet conveying path 8*b* extending from the nip area of the fixing unit 4 to the reverse roller pair 6 is significantly curved. Therefore, when the jammed sheet S is pulled out from the reverse sheet tray 12 with the relatively large force, the force is exerted to inner parts of rollers disposed inside the curved portion of the reverse sheet conveying path 8*b*. Consequently, it is likely to damage the inner parts of the rollers disposed inside the curved portion.

Accordingly, as shown in FIG. 6B, when the sheet S is detected by both the reverse sheet detection sensor 23 and the post-fixing nip detection sensor 22, the controller 120 displays the error recovery process of removing the jammed sheet S via the duplex unit 14 on the operation unit 13 as instructions. In this case, the process displayed on the operation unit 13 instructs the users to open the duplex unit 14 before pulling out the jammed sheet from the duplex conveying path 8*c* of the opened duplex unit 14. In the flowchart illustrated in FIG. 5, according to the detection result that the trailing edge of the sheet S has not passed the post-fixing nip detection sensor 22, the controller 120 causes the operation unit 13 to display the error recovery process of removing the jammed sheet S to the outside of the apparatus body 101 via the duplex conveying path 8*c* of the openable/closable duplex unit 14 in step S4.

Thus, the controller 120 notifies the users of occurrence of paper jam and causes the operation unit 13 to display the error recovery process of removing the jammed sheet S via the duplex unit 14. By so doing, the controller 120 functions as a notifying unit to inform the error recovery process for handling the sheet conveyance error due to the paper jam.

For displaying the error recovery process, the controller 120 reads the reference table in the memory to specify a suitable error recovery process of handling removal of the jammed sheet S in sheet error detection. By so doing, the controller 120 determines the error recovery process according to detection results obtained by each sensor. Accordingly, the controller 120 causes the operation unit 13 to display the specified error recovery process together with occurrence of paper jam.

As described above, the image forming apparatus according to the present embodiment informs that the sheet that is stuck or jammed (i.e., the jammed sheet) in the sheet conveying path due to a paper jam. When the paper jam is detected where the sheet is output to the outside of the image forming apparatus and the trailing edge of the sheet is not held by the nip area of the fixing unit, the controller of the image forming apparatus notifies the users to remove the jammed sheet by pulling out from the outside of the image forming apparatus. Alternatively, when the trailing edge of the sheet is held by the nip area of the fixing unit, the image forming apparatus according to the present embodiment notifies the users to remove the jammed sheet by opening/closing the cover attached to the apparatus body of the image forming apparatus.. As a result, an error recovery handling for the paper jam can be facilitated.

The above-described image forming apparatus 100 according to the present embodiment includes a sheet output roller unit that is disposed downstream from the fixing unit 4 in the sheet conveying path 8 in the sheet conveying direction to convey the sheet S to the outside of the apparatus body 101 of the image forming apparatus 100. The sheet discharging roller pair 5 that discharges the sheet S to the outside of the apparatus body 101 of the image forming apparatus 100 and the reverse roller pair 6 that reverses the sheet S for duplex printing function as the sheet output roller unit. Further, the image forming apparatus 100 according to the present embodiment includes a sheet output detector that is disposed in the vicinity of the sheet output roller unit in the sheet conveying path 8 in the sheet conveying direction to detect the sheet S. The output sheet detection sensor 21 and the reverse sheet detection sensor 23 function as the sheet output detector. Furthermore, the image forming apparatus 100 according to the present embodiment includes the post-fixing nip detection sensor 22 that is disposed in the vicinity of and downstream from the nip area of the fixing unit 4 in the sheet conveying path 8 in the sheet conveying direction to detect the sheet S.

As an example configuration, the image forming apparatus according to the present embodiment includes a sheet output roller unit (e.g., the sheet discharging roller pair 5 and the reverse roller pair 6) to output a recording medium (e.g., the sheet S) to an outside of the image forming apparatus, a sheet output detector (e.g., the output sheet detection sensor 21 and the reverse sheet detection sensor 23) to detect completion of output of the recording medium, a post-fixing nip detector (e.g., the post-fixing nip detection sensor 22) disposed downstream from the nip area of the fixing unit 4 in the sheet conveying path to detect whether the recording medium has passed the nip area of the fixing unit 4, and at least one sheet detector disposed in the sheet conveying path (e.g., the sheet conveying path 8). The image forming apparatus according to the present embodiment further includes an openable/closable duplex unit (e.g., the duplex unit 14) disposed upstream from the sheet output roller unit and provided with a sheet conveying path (e.g., the reverse sheet conveying path 8*b*), an error detector (e.g., the output sheet detection sensor 21, the post-fixing nip detection sensor 22, the reverse sheet detection sensor 23, the controller 120) to detect the paper jam occurred in the sheet conveying path with the jammed recording medium (recording media) stuck therein during the sheet conveying operation, a controller (e.g., the controller 120), a memory to specify an operation process of removing jammed sheet in sheet error detection, and a notifying unit (e.g., the controller 120 and the operation unit 13) to notify a user of the process specified by the memory for removing the jammed sheet.

In the present embodiment, when the error detector detects that the paper jam has occurred with the recording medium remaining in the sheet conveying path and the sheet output detector detects that the recording medium remains in a detection area, the controller notifies a user of occurrence of the paper jam and displays a process of removing the jammed recording medium stuck in the sheet conveying path, according to output results of the post-fixing nip detector with respect to the jammed recording medium stopped in the sheet conveyance error.

As described above, the controller notifies a user of a process of removing the jammed sheet by displaying on the notifying unit to pull out the jammed recording medium from the sheet output roller unit to the outside of the image forming apparatus under conditions that the error detector detects that the recording medium is jammed at a position where the recording medium is output to the outside of the apparatus body of the image forming apparatus and that the trailing edge of the jammed recording medium is not held by the nip area of the fixing unit.

Further, when the recording medium is held by the nip area of the fixing unit, the controller notifies a user of sheet error detection and displays an error recovery process on the notifying unit to pull out the jammed recording medium to the outside of the image forming apparatus from an openable/closable part (e.g., the duplex unit 14) that is arranged at a different part from the sheet output roller unit. Therefore, the notifying unit displays the process of removing the jammed recording medium stopped in the fixing unit and held by the nip area of the fixing unit from the sheet conveying path of the openable/closable part while the openable/closable part is open. As an example, the above-described embodiment employs the duplex unit 14.

With this configuration, in the present embodiment, even when the jammed recording medium is stuck in the vicinity of the sheet output roller unit at occurrence of the paper jam is detected, the controller can select an appropriate one from different error recovery processes according to whether or not the jammed sheet is held by the nip area of the fixing unit. Therefore, the error recovery process of paper jam handling can be facilitated.

Further, a simpler error recovery process of the paper jam handling can be presented according to the state of the jammed recording medium, the error recovery process used by a user can be clarified and simplification of the paper jam handling can be assisted.

Further, when the above-described image forming apparatus according to the present embodiment notifies the users of the process of removing the jammed recording medium from the sheet conveying path provided in the openable/closable duplex unit, the controller notifies a user of a sheet conveyance error with a process of opening the duplex unit 14 before pulling out the jammed recording medium.

With this configuration, the present embodiment can assist completion of the paper jam reliably.

Further, the sheet output roller unit such as the sheet discharging roller pair 5 and the reverse roller pair 6 according to the above-described embodiment is arranged to have a force of 22.2 N maximum to pull out the recording medium to the outside of the apparatus body when the recording medium is held by the sheet output roller unit.

As described above, according to the present embodiment, the force to be applied for pulling out the recording medium to the outside of the image forming apparatus is set to be equal to or smaller than a force required to activate controls recommended in Section 508 of the US Rehabilitation Act. By so doing, any user can pull out the jammed recording medium to the outside of the image forming apparatus easily.

It is to be noted that the above-described embodiments are preferred embodiments of the present invention. The present invention is not limited thereto but can be implemented various modifications based on a technical idea of the present invention.

For example, the fixing unit 4 is not limited to be applied to a configuration in which the nip area is formed by a fixing roller and a pressure roller as described above. For example, a nip area is formed a fixing belt and a process roller functioning as rotary bodies to rotate while facing each other, or other rotary bodies.

Further, the sheet output roller unit is not limited to the sheet discharging roller pair 5 and the reverse roller pair 6 according to the present embodiment.

Figure 7A:
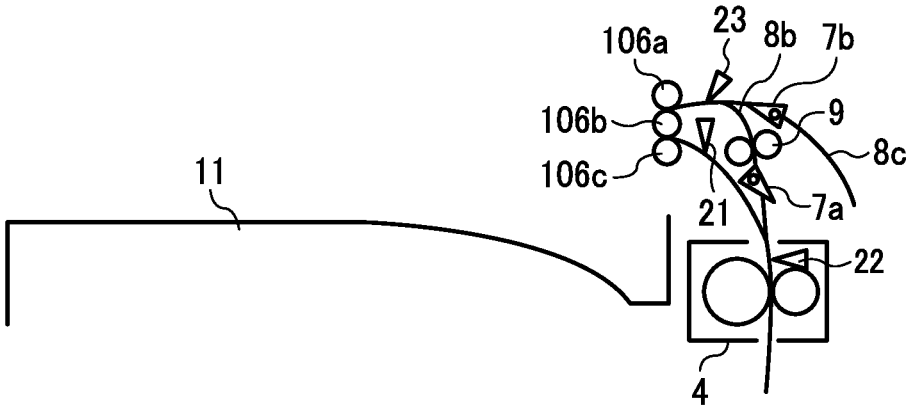
FIG. 7A is a diagram illustrating another example of occurrence of sheet conveyance error detected by the output sheet detection sensor and the reverse sheet detection sensor.

For example, multiple sheet discharge and reverse rollers 106*a*, 106*b*, and 106*c* can be applied to the present invention, as illustrated in FIG. 7A. The multiple sheet discharge and reverse rollers 106*a*, 106*b*, and 106*c* function as a sheet output roller unit. The sheet discharge and reverse rollers 106*a* and 106*b* have the same function as the reverse roller pair 6 and rotate in both a forward direction and a backward direction with respect to the sheet conveying direction. The sheet discharge and reverse rollers 106*b* and 106*c* have the same function as sheet discharging roller pair 5.

For a one-side printing operation, the sheet S having the fixed toner image thereon is discharged by the sheet discharge and reverse rollers 106*b* and 106*c* toward the outside of the image forming apparatus 100 onto the sheet discharging tray 11.

For the duplex printing operation, after the toner image is fixed to the front side of the sheet S in the fixing unit 4 during the duplex printing operation, the separators 7*a* and 7*b* switch the direction of sheet conveyance. By so doing, the sheet S is conveyed toward the sheet discharge and reverse rollers 106*a* and 106*b* via the reverse relay roller pair 9. The sheet discharge and reverse rollers 106*a* and 106*b* that function as a sheet output roller unit rotates to output a part of the sheet S to the sheet discharging tray 11, and then reverses its rotation to convey the sheet S to the duplex conveying path 8*c* in the duplex unit 14. Then, the sheet S is conveyed to the registration roller pair 2 again to perform the duplex printing operation onto the back side of the sheet S.

According to this configuration, the number of rollers can be reduced, thereby providing a simpler and more compact image forming apparatus.

Figure 7B:
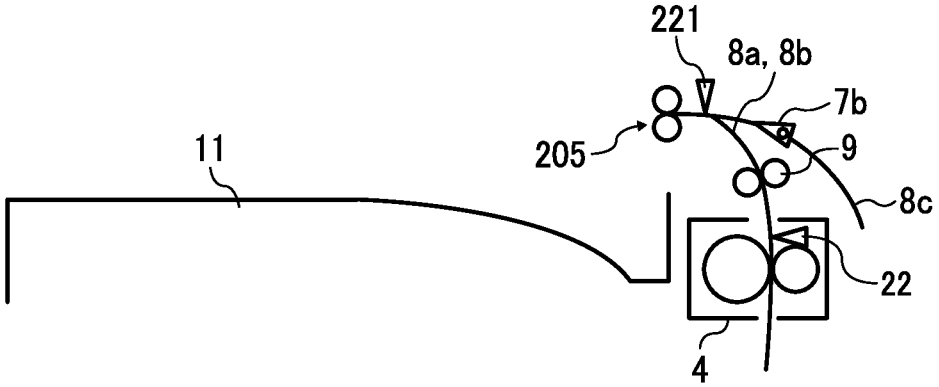
FIG. 7B is a diagram illustrating another example of occurrence of sheet conveyance error detected by an output and reverse sheet detection sensor.

Further, for example, a sheet discharge and reverse roller pair 205 can be applied to the present invention as illustrated in FIG. 7B. The sheet discharge and reverse roller pair 205 functions as a sheet output roller unit. The sheet discharge and reverse roller pair 205 has the same function as the sheet discharging roller pair 5 and the reverse roller pair 6 and rotate in both a forward direction and a backward direction with respect to the sheet conveying direction.

For a one-side printing operation, the sheet S having the fixed toner image thereon is discharged by the sheet discharge and reverse roller pair 205 toward the outside of the image forming apparatus 100 onto the sheet discharging tray 11.

For the duplex printing operation, after the toner image is fixed to the front side of the sheet S in the fixing unit 4 during the duplex printing operation, the separator 7*b* switches the direction of sheet conveyance. By so doing, the sheet S is conveyed toward the sheet discharge and reverse roller pair 205 via the reverse relay roller pair 9. The sheet discharge and reverse roller pair 205 that function as a sheet output roller unit rotates to output a part of the sheet S to the sheet discharging tray 11, and then reverses its rotation to convey the sheet S to the duplex conveying path 8*c* in the duplex unit 14. Then, the sheet S is conveyed to the registration roller pair 2 again to perform the duplex printing operation onto the back side of the sheet S. Further, the configuration illustrated in FIG. 7B includes an output and reverse sheet detection sensor 221. The output and reverse sheet detection sensor 221 includes the same functions as the output sheet detection sensor 21 and the reverse sheet detection sensor 23.

According to this configuration, the number of rollers and the number of sensors can be reduced, thereby providing a simpler and more compact image forming apparatus.

Further, the notification made by the notifying unit is not limited to the above-described manner(s) according to the present embodiment. For example, an audio notifying unit can be applied to the present invention.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus comprising:

an apparatus body;

a fixing unit disposed in the apparatus body and having rotary bodies disposed facing each other with a nip area formed there between, the fixing unit fixing an image to a recording medium at the nip area while the rotary bodies are rotating;

a sheet conveying path through which the recording medium is conveyed in a sheet conveying direction;

a sheet output roller unit disposed downstream from the fixing unit in the sheet conveying direction, the sheet output roller unit outputting the recording medium to an outside of the apparatus body;

a sheet output detector disposed in a vicinity of the sheet output roller unit in the sheet conveying path, the sheet output detector detecting presence of the recording medium;

a post-fixing nip detector disposed downstream from the nip area of the fixing unit in the sheet conveying path, the post-fixing nip detector detecting presence of the recording medium;

an error detector to detect a sheet conveyance error occurred during a sheet conveying operation;

a notifying unit to notify a user of an error recovery process when the sheet conveyance error is detected by the error detector;

an openable/closable part provided separate from which the recording medium is output to the outside of the apparatus body by the sheet output roller unit; and a controller, wherein a distance from the post-fixing nip detector to the sheet output detector in the sheet conveying path is smaller than a given size of the recording medium in the sheet conveying path, wherein, under conditions that the sheet conveyance error is detected by the error and that the recording medium is detected by the sheet output detector, the controller causes the notifying unit to display the error recovery process according to whether the recording medium is detected by the post-fixing nip detector, and wherein, under conditions that the sheet conveyance error is detected by the error detector and that the recording medium is detected by the sheet output detector and the post-fixing nip detector, the controller causes the notifying unit to display, as the error recovery process, a second error recovery process of removing the recording medium that is held and stopped in the nip area of the fixing unit to the outside of the apparatus body via the openable/closable part by opening the openable/closable part.

2. The image forming apparatus according to claim 1, further comprising an openable/closable part provided separate from which the recording medium is output to the outside of the apparatus body by the sheet output roller unit, wherein, under conditions that the sheet conveyance error is detected by the error detector, that the recording medium is detected by the sheet output detector, and that the recording medium is not detected by the post-fixing nip detector, the controller causes the notifying unit to display, as the error recovery process, a first error recovery process of removing the recording medium that is stuck in the apparatus body to the outside of the apparatus body via the sheet output roller unit.

3. The image forming apparatus according to claim 2, wherein the sheet conveying path comprises a duplex conveying path for duplex printing, wherein the openable/closable part has the duplex conveying path.

4. The image forming apparatus according to claim 1, wherein a sheet output roller unit pair includes a sheet discharging roller pair to discharge the recording medium conveyed through the sheet conveying path, wherein the sheet output detector is disposed in the vicinity of the sheet discharging roller pair in the sheet conveying path.

5. The image forming apparatus according to claim 1, wherein the sheet conveying path comprises a duplex conveying path for duplex printing, wherein the sheet output roller unit includes a reverse roller pair to output a part of the recording medium outside the sheet conveying path before the recording medium is reversed and conveyed to the duplex conveying path, wherein the sheet output detector is disposed in the vicinity of the reverse roller pair in the duplex conveying path.

6. The image forming apparatus according to claim 1, wherein the sheet conveying path comprises a duplex conveying path for duplex printing, wherein a sheet output roller unit pair includes multiple sheet discharge and reverse rollers to discharge the recording medium conveyed through the sheet conveying path and output a part of the recording medium outside the sheet conveying path before the recording medium is reversed and conveyed to the duplex conveying path, wherein the sheet output detector is disposed in the vicinity of the multiple sheet discharge and reverse rollers in the sheet conveying path and the duplex conveying path.

7. The image forming apparatus according to claim 1, wherein the sheet output roller unit exerts a force of 22.2 N maximum to pull out the recording medium from the sheet output roller unit.

8. A method of handling a sheet conveyance error in an image forming apparatus, the method comprising:

providing a sheet output detector, a post-fixing nip detector, and an error detector to detect presence of a recording medium;

providing an openable /closable part to reverse and convey the recording medium for a duplex printing operation;

detecting the sheet conveyance error that the recording medium is jammed in a vicinity of a fixing unit of the image forming apparatus;

determining whether or not the recording medium is held by rotary bodies of the fixing unit; and notifying a user of detection of the sheet conveyance error by displaying one of:

a first error recovery process of removing the recording medium via the sheet output roller unit when the recording medium is detected by the sheet output detector and the recording medium is not held by the rotary bodies of the fixing unit; and a second error recover process of removing the recording medium via the openable/closable part when the recording medium is detected by the sheet output detector and the post-fixing nip detector and the recording medium is held by the rotary bodies of the fixing unit, wherein, under conditions that the sheet conveyance error is detected by the error detector and that the recording medium is detected by the sheet output detector and the post-fixing nip detector, displaying, as the error recovery process, the second error recovery process of removing the recording medium that is held and stopped in the nip area of the fixing unit to the outside of the apparatus body via the openable /closable part by opening the openable/closable part.

* * * * *